US005642860A

United States Patent [19]

Bush et al.

[11] Patent Number: 5,642,860

[45] Date of Patent: Jul. 1, 1997

[54] PUMP SPRAYER FOR VISCOUS OR SOLIDS LADEN LIQUIDS

[75] Inventors: Stephan G. Bush; Dimitris I. Collias; Stephen F. Evans, all of Cincinnati, Ohio

[73] Assignee: The Procter & Gamble Company, Cincinnati, Ohio

[21] Appl. No.: 625,833

[22] Filed: Apr. 1, 1996

Related U.S. Application Data

[63] Continuation-in-part of Ser. No. 604,556, Feb. 21, 1996, abandoned, which is a continuation-in-part of Ser. No. 499,753, Jul. 7, 1995.

[51] Int. Cl.[6] ..... B05B 9/043

[52] U.S. Cl. ..... 239/333; 239/599; 239/602; 239/DIG. 12; 239/DIG. 19

[58] Field of Search ..... 239/333, 597, 239/599, 601, 602, DIG. 12, DIG. 19, 533.13, 123, 121, 120, 114–116, 107, 106; 222/383.1

[56] References Cited

U.S. PATENT DOCUMENTS

| | | | |
|---|---|---|---|
| D. 198,356 | 6/1964 | Wahlin | 23/213 |
| D. 226,712 | 4/1973 | Tada | D23/226 |
| 1,636,314 | 7/1927 | Murray | 239/533.14 |
| 2,308,476 | 1/1943 | Gerrer | 239/533.14 |
| 2,373,555 | 4/1945 | Folke | 239/533.13 |
| 2,460,647 | 2/1949 | Miller | 138/43 |
| 2,621,078 | 12/1952 | Wahlin | 239/597 |
| 2,755,137 | 7/1956 | Hughf | 239/602 X |
| 2,812,213 | 11/1957 | Bede | 239/544 |

(List continued on next page.)

FOREIGN PATENT DOCUMENTS

| | | | |
|---|---|---|---|
| 554493 | 1/1960 | Belgium | 239/599 |
| 0466157 | 1/1992 | European Pat. Off. . | |

(List continued on next page.)

OTHER PUBLICATIONS

Atomization and Sprays by Arthur H. Lefebvre, 1989 (pp. 6, 10, 61, 125–127).

Mechanisms of liquid sheet breakup and the resulting drop size distributions, Feb. 1992 Tappi Journal, (pp. 136–142).

Continental Sprayers, Inc., 922 Ajust-o-Spray pamphlet.

Lechler, Catalog #140, Industrial Spray Nozzles, Systems and Accessories, (pp. 2–10, 37–47).

(List continued on next page.)

*Primary Examiner*—Lesley D. Morris

*Attorney, Agent, or Firm*—Michael E. Hilton; Daniel F. Nesbit; Michael J. D'Amelio

[57] ABSTRACT

A hand holdable spray delivery system for dispensing a relatively viscous and/or solids laden liquid is provided. This spray delivery system includes a container adapted to house the liquid. A manually actuated pump device is mounted on the container. The pump device including an inlet passage, a pump chamber, and a discharge passage having a distal end connected in liquid communication so that the liquid is pumped from within the container, through the inlet passage, into the pump chamber and through the discharge passage upon manual actuation of the pump device. A slotted spray nozzle including a housing having an inlet side and an exit side is also included. The housing having an internal recess through the inlet side that terminates in an elongated orifice at the exit side. The internal recess being attached in liquid communication to the distal end of the discharge passage such that the liquid passing through the discharge passage flows through the slotted spray nozzle and converges toward the elongated orifice. The liquid is dispensed therefrom in a dispersed spray. The slotted spray nozzle can be made of a rigid material or an elastomeric material. A fan shaped dispersed spray pattern is generated when the nozzle is made using a rigid material, however, when an elastomeric material is utilized, the nozzle is capable of ejecting particles larger than the smallest dimension of the elongated orifice, thereby substantially reducing the likelihood of clogging. Several versions of the spray delivery system are illustrated, including a trigger operated sprayer and a reciprocating finger pump.

17 Claims, 9 Drawing Sheets

U.S. PATENT DOCUMENTS

| | | | |
|---|---|---|---|
| 2,834,635 | 5/1958 | Miller | 239/11 |
| 2,941,544 | 6/1960 | Peras | 137/844 |
| 2,985,386 | 5/1961 | Steinen | 239/597 |
| 3,214,102 | 10/1965 | Meyer | 239/107 |
| 3,250,474 | 5/1966 | McKernan | 239/123 X |
| 3,266,735 | 8/1966 | Webb | 239/284.1 |
| 3,286,931 | 11/1966 | Webb | 239/284.1 |
| 3,288,371 | 11/1966 | Broughton | 239/107 |
| 3,346,195 | 10/1967 | Groth | 239/337 |
| 3,351,292 | 11/1967 | Stuart, Sr. | 239/533.13 |
| 3,395,344 | 7/1968 | Bader | 324/71.1 |
| 3,428,223 | 2/1969 | Lewiecki et al. | 222/398 |
| 3,488,006 | 1/1970 | Gigantino | 239/602 X |
| 3,545,682 | 12/1970 | Beard | 239/469 |
| 3,647,147 | 3/1972 | Cook | 239/599 |
| 3,701,478 | 10/1972 | Tada | 239/333 |
| 3,780,946 | 12/1973 | Smith et al. | 239/107 |
| 4,011,992 | 3/1977 | Olsen | 239/135 |
| 4,097,000 | 6/1978 | Derr | 239/599 |
| 4,109,869 | 8/1978 | Brockelsby et al. | 239/491 |
| 4,127,419 | 11/1978 | Szuhaj et al. | 106/243 |
| 4,142,003 | 2/1979 | Sejpal | 426/601 |
| 4,143,820 | 3/1979 | Bright, Sr. | 239/108 |
| 4,155,770 | 5/1979 | Doumani | 106/267 |
| 4,156,398 | 5/1979 | McDaniel | 118/704 |
| 4,161,288 | 7/1979 | McKinney | 239/333 |
| 4,174,069 | 11/1979 | Grogan | 139/333 |
| 4,227,650 | 10/1980 | McKinney | 239/333 |
| 4,241,878 | 12/1980 | Underwood | 239/591 |
| 4,249,681 | 2/1981 | French | 222/380 |
| 4,252,507 | 2/1981 | Knickerbocker | 417/444 |
| 4,256,526 | 3/1981 | McDaniel | 156/295 |
| 4,283,012 | 8/1981 | Hanson | 239/118 |
| 4,346,849 | 8/1982 | Rood | 239/597 |
| 4,384,008 | 5/1983 | Millisor | 426/613 |
| 4,385,076 | 5/1983 | Crosby | 426/533 |
| 4,401,271 | 8/1983 | Hansen | 239/337 |
| 4,401,272 | 8/1983 | Merton et al. | 239/337 |
| 4,611,759 | 9/1986 | Cox | 239/229 |
| 4,618,101 | 10/1986 | Piggott | 239/599 X |
| 4,627,414 | 12/1986 | Chazin | 126/215 |
| 4,736,892 | 4/1988 | Calder | 239/599 X |
| 4,747,523 | 5/1988 | Dobbs | 222/383.1 |
| 4,749,108 | 6/1988 | Dornbusch | 222/212 |
| 4,869,431 | 9/1989 | Jubert et al. | 239/533.13 |
| 4,893,754 | 1/1990 | Ruiz | 239/601 |
| 4,905,911 | 3/1990 | Sakuma | 239/599 |
| 4,925,699 | 5/1990 | Fagan | 427/483 |
| 4,986,453 | 1/1991 | Lina et al. | 222/321.2 |
| 4,988,043 | 1/1991 | Lechler | 239/597 |
| 5,004,123 | 4/1991 | Stoody | 222/94 |
| 5,005,737 | 4/1991 | Rohr | 222/212 |
| 5,033,676 | 7/1991 | King et al. | 239/107 |
| 5,071,017 | 12/1991 | Stull | 215/260 |
| 5,074,471 | 12/1991 | Baumgarten et al. | 239/284.1 |
| 5,080,286 | 1/1992 | Morrison | 239/533.13 |
| 5,088,649 | 2/1992 | Hanson et al. | 239/329 |
| 5,110,616 | 5/1992 | Lair et al. | 427/9 |
| 5,115,978 | 5/1992 | King et al. | 239/107 |
| 5,133,502 | 7/1992 | Bendig et al. | 239/504 |
| 5,137,793 | 8/1992 | Cockrell, Jr. | 428/688 |
| 5,193,746 | 3/1993 | Iwamura et al. | 239/109 |
| 5,222,522 | 6/1993 | Rontome | 137/845 |
| 5,228,625 | 7/1993 | Grassberger | 239/558 |
| 5,246,170 | 9/1993 | Woidt | 239/520 |
| 5,249,747 | 10/1993 | Hanson et al. | 239/373 |
| 5,265,808 | 11/1993 | Gordon et al. | 239/533.13 |
| 5,271,566 | 12/1993 | Dederich | 239/600 |
| 5,323,963 | 6/1994 | Ballu | 239/63 |
| 5,339,995 | 8/1994 | Brown et al. | 222/173 |
| 5,358,179 | 10/1994 | Lund et al. | 239/333 |
| 5,366,553 | 11/1994 | Lair et al. | 118/682 |
| 5,372,311 | 12/1994 | Nye | 239/320 |
| 5,405,089 | 4/1995 | Heimann et al. | 239/533.14 |
| 5,455,055 | 10/1995 | Stolz | 426/115 |
| 5,538,188 | 7/1996 | Simonette | 239/599 |

FOREIGN PATENT DOCUMENTS

| | | |
|---|---|---|
| 2689864 | 10/1993 | France . |
| 2440909 | 4/1975 | Germany . |
| 344632 | 3/1960 | Switzerland . |
| 341580 | 6/1972 | U.S.S.R. . |
| 1211511 | 2/1986 | U.S.S.R. . |
| 1445641 | 12/1988 | U.S.S.R. . |
| 001729602 | 4/1992 | U.S.S.R. . |
| 83/00134 | 1/1983 | WIPO . |
| 90/14893 | 12/1990 | WIPO . |
| 93/06749 | 4/1993 | WIPO . |
| 93/21081 | 10/1993 | WIPO . |
| 94/13409 | 6/1994 | WIPO . |

OTHER PUBLICATIONS

Thermoplastic Elastomers: A Rising Star Marc T. Payne and Charles P. Rader, Chap. 14 (1993).

The Regulation of Flow Through Residual Spray Nozzles, Richard P. Lonergan, Lawrence B. Hall, pp. 955–959, 1959.

The Regulation of Flow Through Residual Spray Nozzles, Richard P. Lonergan, Lawrence B. Hall, pp. 961–971, 1959.

*Pattern Measurements in Fan Spray Atomizers with High Viscosity Fluids* by Steven G. Bush, Dimitris I. Collias (May, 1996).

Thermoplastic Elastomers—A Comprehensive Review, Edited by N.R. Legge, G. Holden, H.E. Schroeder (Jul. 1987): Chapter 13—*Applications of Thermoplastic Elastomers* by G. Holden (pp. 481–506).

PUMP SPRAYER FOR VISCOUS OR SOLIDS LADEN LIQUIDS

CROSS-REFERENCE TO RELATED APPLICATION

This is a continuation-in-part of application Ser. No. 08/604,556, filed on Feb. 21, 1996 and now abandoned, which is a continuation-in-part of application Ser. No. 08/499,753, filed on Jul. 7, 1995.

FIELD OF THE INVENTION

The present invention relates to packages for dispensing liquid products; and more particularly, to a manually operated spray delivery system for dispensing of difficult to spray (e.g. viscous and/or solids laden) liquids in a dispersed spray.

BACKGROUND OF THE INVENTION

The quantity of the liquid product dispensed and the quality of the dispersed spray are important parameters which can have a substantial impact on the performance of a liquid product applied via an atomized spray. This is particularly true when a relatively viscous or solids laden liquid product is being utilized to form a thin, uniform coating on a surface, and the total quantity of liquid product applied and quality of the dispersed spray directly impact the thickness and uniformity of the product coating.

Aerosol spray type dispensers have been utilized to atomize relatively viscous liquids, however, recently there has been a trend away from aerosol-type dispensing systems for environmental reasons. Thus, the use of a propellant, regardless of the type, makes an aerosol container less desirable than hand pump type spray dispensers.

Many manually actuated hand pump type spray dispensers have also been utilized to atomize liquids. However, when dispensing relatively viscous products such as cooking oil or vegetable oil based pan coatings, these devices have generally resorted to a dual stream impingement type nozzle. There are some problems and disadvantages to the impingement type nozzle when used to dispense such products. These impingement type nozzles are more difficult to manufacture because the individual passages of the nozzle must be accurately aligned with the precision required for repetitively producing discharge streams that intersect or collide at a particular point in order for atomization of the liquid product to occur. Additionally, the small size of the multiple exit orifices required in an impingement nozzle, for increasing the velocity of the liquid, are prone to clog when dispensing a solids laden liquid product.

When using a manually actuated pump sprayer to dispense a relatively viscous liquid product certain challenges exist, especially when attempting to dispense the liquid in a dispersed spray. A dispersed spray as used herein, for example, is a dispensed liquid which breaks up and forms droplets or disintegrates into an atomized spray. The dispersed spray can contain droplets of liquid that are finely dispersed, such as an atomized spray, or even more coarsely dispersed representing larger droplets of liquid. Relatively viscous liquids typically have a tendency to resist break-up rather than easily being dispensed in a dispersed spray. As a general proposition, the less finely dispersed the atomized spray, the more difficult it is to achieve a comparatively thin and uniform coating of product on a surface.

Also problematic when dispensed using a manually actuated pump sprayer are solids laden liquid products, that is, liquids having a substantial amount of solid materials suspended in them. Typically, liquid products that contain solid particles have a tendency to clog and obstruct the small passageways of spray nozzles. Thus, dispensing of liquid products in a dispersed spray is especially problematic when the relatively viscous liquid also contains a substantial amount of solid materials.

One particularly troublesome product to dispense with a manually operated pump sprayer because of its relatively viscous and generally solids laden nature, is a vegetable oil based liquid product used in food preparation, such as, for example, pan coatings and liquid flavor enhancers. Such liquid products usually comprise a vegetable oil and can optionally include a quantity of additives for stability, performance, and flavor enhancement. A thin, uniform coating of an oil-based product is desirable in order to provide for non-stick baking characteristics in the pan and to prevent over-application of the flavor enhancers. These products generally have a comparatively high viscosity and these relatively viscous products can also include a substantial amount of solids or particles suspended in them.

SUMMARY OF THE INVENTION

In one aspect of the present invention, a hand holdable spray delivery system for dispensing a liquid is provided. This spray delivery system includes a container adapted to house the liquid. The liquid being a vegetable oil based cooking spray having a viscosity from about 80 to about 300 centipoise and being a solids laden liquid. This relatively viscous and solids laden liquid can contain up to about 10% solid particulate material including salt particles. A manually actuated pump device is mounted on the container. The pump device includes an inlet passage, a pump chamber, and a discharge passage having a distal end. All these being connected in liquid communication so that the liquid can be pumped from within the container, through the inlet passage, into the pump chamber and through the discharge passage upon manual actuation of the pump device. A spray nozzle including a housing having an inlet side and an exit side is also included. The exit side can be made of an elastomeric material and the elastomeric material having a hardness between about 40 Shore A to about 60 Shore D. The elastomeric material further having a flexural modulus of between about 1,000 psi to about 25,000 psi. The entire spray nozzle can, alternatively, be constructed of an elastomeric material. The housing having an internal recess through the inlet side that terminates in an elongated orifice at the exit side. The internal recess having a dome shaped interior surface therein and the exit side having a V-shaped groove therein which intersects with the interior surface to form an elongated orifice. The internal recess being attached in liquid communication to the distal end of the discharge passage such that the liquid passing through the discharge passage flows through the spray nozzle and converges toward the elongated orifice. The elastomeric material allows the elongated orifice to resiliently distort thereby substantially reducing the likelihood of clogging when the liquid is dispensed therefrom in a dispersed spray. A post can also be provided. The post being affixed to the distal end of the discharge passage. The open position allowing the liquid to flow through the discharge passage around the post.

In one alternative embodiment the spray nozzle further includes an insert. The insert being contained within the housing and the insert having the elongated orifice formed therein. The internal recess further including an interior surface and an engagement rim. The engagement rim being located at the exit side of the housing. The engagement rim extending radially inward from the interior surface and terminating at a location spaced radially outboard of the elongated orifice wherein the insert is maintained within the internal recess by the engagement rim. The insert can be constructed of an elastomeric material allowing the elongated orifice to resiliently distort thereby substantially reducing the likelihood of clogging during use.

In another alternative embodiment the housing further includes a first segment affixed to a second segment. The first segment being located at the inlet side having the internal recess extending therethrough and the second segment being located at the outlet side having the elongated orifice therein. The second segment being made of an elastomeric material, such as a thermoplastic copolyester. The elastomeric material allows the elongated orifice to resiliently distort thereby substantially reducing the likelihood of clogging during use.

The pump device further comprising a trigger operated sprayer including a trigger and a piston. The trigger serves as an actuator which reciprocally engages the piston. The pump device can, alternatively, comprise a reciprocating finger pump having a finger button and a piston with the spray nozzle being connected to the finger button so as to be in liquid communication with the discharge passage. This finger button reciprocally engages the piston. In both embodiments, the piston is slidably fitted within the pump chamber in order to effectuate actuation of the spray delivery system.

BRIEF DESCRIPTION OF THE DRAWINGS

While the specification concludes with claims which particularly point out and distinctly claim the invention, it is believed that the present invention will be better understood from the following description taken in conjunction with the appended claims and the accompanying drawings, in which like reference numerals identify identical elements and wherein;

DETAILED DESCRIPTION OF THE INVENTION

Figure 1:
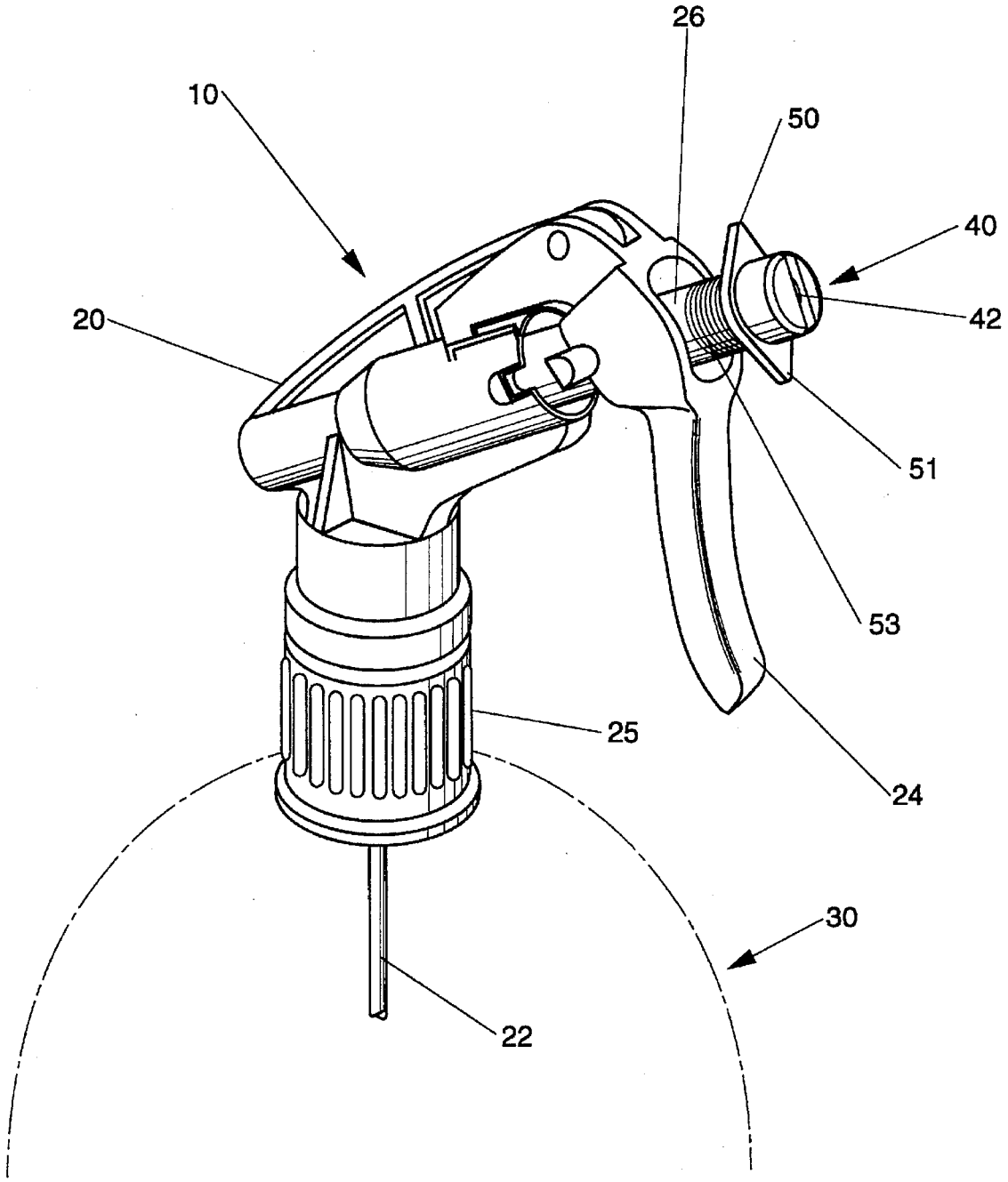
FIG. 1 is a perspective view of a spray delivery system according to the present invention, with the container shown via phantom line.

In a particularly preferred embodiment seen in FIG. 1, the present invention provides a hand holdable spray delivery system for dispensing a liquid, indicated generally as 10. This spray delivery system 10 substantially reduces the likelihood of clogging during use. The spray delivery system 10 includes a slotted spray nozzle 40 connected to a manually actuated pump device 20 and a container 30 (shown in outline only). The container 30 is adapted to house a liquid. Hand holdable as used herein refers to the ability of a single consumer to carry and use this spray delivery system 10 preferably by simply gripping the manually actuated pump device 20 with one hand.

Figure 2:
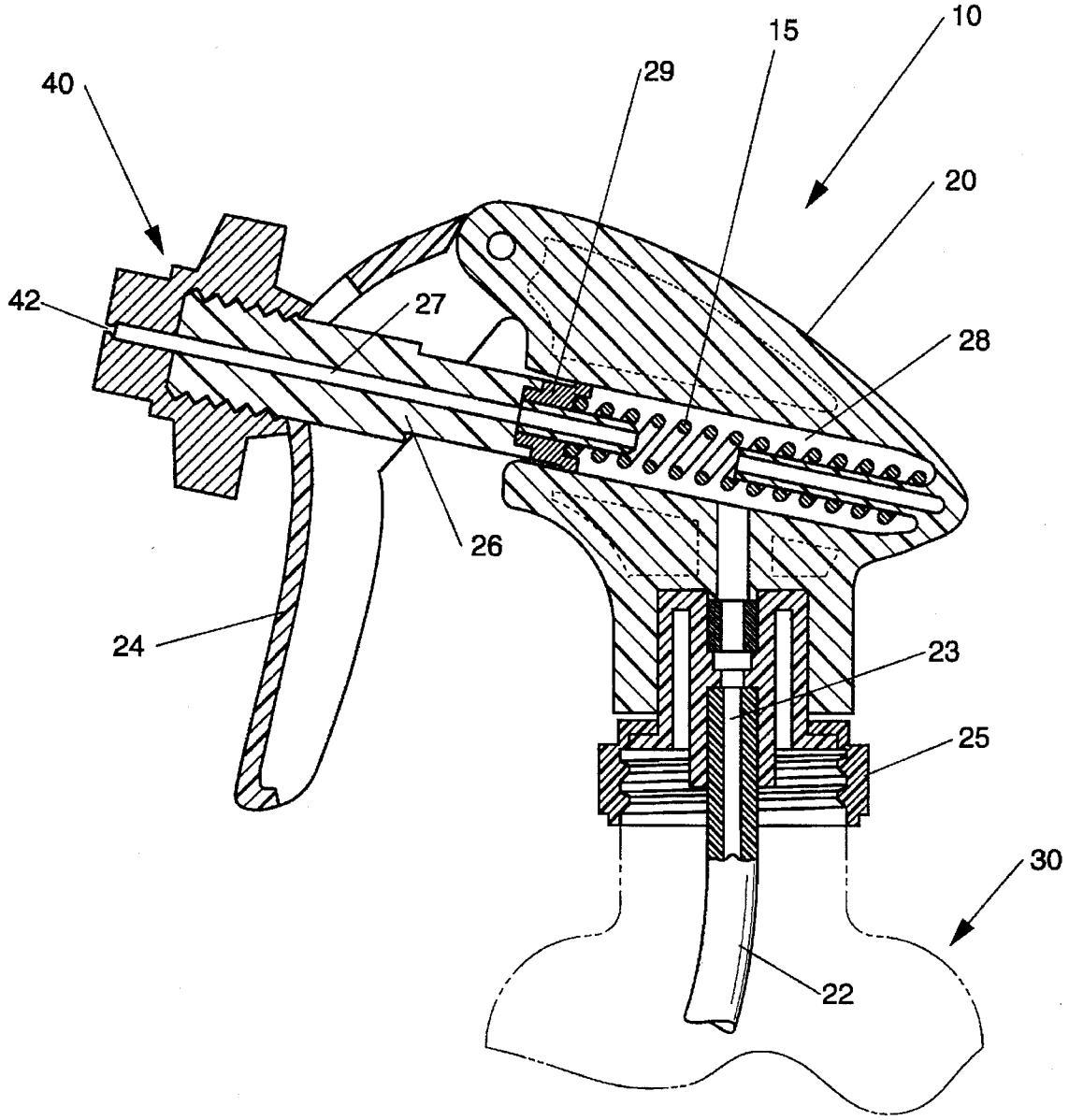
FIG. 2 is a partial cross-section of the spray delivery system seen in FIG. 1, according to the present invention.

Referring now to FIG. 2, an inlet tube 22 having an inlet passage 23 therethrough extends downward into the container 30 from the pump device 20. The slotted spray nozzle 40 is connected to a discharge tube 26 of the pump device 20. The discharge tube 26 has a discharge passage 27 extending therethrough, the discharge passage 27 having a distal end and a proximate end. The proximate end of the discharge passage 27 is connected to a pump chamber 28. The slotted spray nozzle 40 being attached in liquid communication to the distal end of the discharge passage 27 such that the liquid passing through the discharge passage 27 flows through the slotted spray nozzle 40 and is dispensed therefrom in a dispersed spray.

A wide variety of manually operated pump sprayer type mechanisms are suitable for use in the present invention. A more detailed description of the features and components of the pump device 20 can be found in U.S. Pat. No. 3,701,478 issued Oct. 31, 1972 to Tada, which is hereby incorporated herein by reference. Pump devices 20 of this general type are commercially available versions sold by Continental Manufacturing Co. under the trade name "922 Industrial Sprayer". While the above-mentioned pump device 20 is presently preferred, many other standard manually operated pump sprayer mechanisms could also function in this capacity. The particular trigger operated sprayer type pump device 20 seen in FIG. 2 is illustrative of the operating features typical of such manually actuated pumps and is a presently preferred configuration for commercial applications.

As seen in FIG. 2 the pump device 20 is used to convey liquid from the container 30, to pressurize the liquid, and to pass this pressurized liquid through the slotted spray nozzle 40. In this presently preferred embodiment, the trigger 24 serves as an actuator that reciprocally engages a piston 29 that is slidably fitted within the pump chamber 28 in order to effectuate actuation of the spray delivery system 10. It is preferable for the pump device 20 to dispense a dose from about 1 cc to about 3 cc of liquid during each actuation stroke or dispensing cycle. The force required to dispense the liquid is the amount of force that the operator must exert on the trigger 24 in order to actuate the pump device 20. This force to dispense should be easy and non-fatiguing to the operator's fingers and hand. Preferably, the force to dispense is less than about 10 pounds at an actuation rate of from about 3 inches per second to about 4 inches per second; and more preferably, the force to dispense is from about 5 pounds to about 8 pounds.

Certain aspects of the configuration of the pump device 20 are dependent on the nature of the liquid which is to be dispensed. The liquid dispensed by this spray delivery system 10 can be a relatively viscous liquid. In the case of a Newtonian liquid (where viscosity is not dependent on shear rate) the absolute viscosity of the liquid is measured using, for example, a Haake RV20 Rotovisco rotary rheometer. One configuration of this rheometer used for relatively viscous liquids is the PK45/4° cone and plate system. The clearance from plate to cone truncation for this system is about 0.175 mm. The sample temperature is maintained at from about 21° C. to about 25° C., which is representative of room temperature conditions. Rotation of the plate induces shear in the sample between the plate and cone. The viscosity is calculated by the software from the resultant shear induced torque on the cone. This viscosity data is obtained using the Haake Rotovisco software version 2.1, where the shear rate is programmed by the user and the ensuing data acquisition and post processing are automated processes. Shear rate is programmed by decades (e.g., 0.1, 1, 10, 100) so that the data distribution is relatively uniform on a logarithmic scale. The beginning and ending shear rates for each decade are programmed along with time intervals such that the acceleration of the rotating plate is substantially uniform. Rheology measurements covered a shear rate interval of from about 0.1 to 300 reciprocal seconds in about 5 minutes. The acquired data is plotted in order to evaluate viscosity at different shear rates by directing the software to plot viscosity versus shear rate on logarithmic scales. In particular, relatively viscous Newtonian liquids for use in this spray delivery system 10 are liquids which, preferably, have a viscosity greater than about 60 centipoise; more preferably, a viscosity from about 80 centipoise to about 300 centipoise; and most preferably, a viscosity from about 80 centipoise to about 170 centipoise.

In the case of a non-Newtonian liquid (where viscosity varies with shear rate), the term high shear rate refers to shear rates found in the exit regions of the slotted spray nozzle 40, and are from about 100,000 to 200,000 reciprocal seconds. These high shear rates occur at the elongated orifice 42 and in particular are for a 1 cc dose using the most preferred dimensions of the elongated orifice 42. The theology of a non-Newtonian liquid is characterized using, for example, an Instron Capillary Rheometer System model 3211 along with the manufacturer's prescribed test procedure. The procedure for measuring a high shear rate viscosity using this system includes the use of about a 0.010 inch inner diameter by about 1.5 inch length die, a lead cell with about a 50 lbf range, a plunger feed rate of from about 3 to 10 inches per minute, at room temperature conditions. Movement of the plunger through the barrel of the instrument muses flow of the material though the die at a fixed shear rate. The pressure drop through the die is inferred by measurement of the force required to drive the plunger. The output data is in the form of force data, which is post processed to yield viscosity versus shear rate curves using formulas supplied by the manufacturer. In particular, relatively viscous non-Newtonian liquids for use in this spray delivery system 10 are liquids which, preferably, have a high shear rate viscosity greater than about 60 centipoise; more preferably, a high shear rate viscosity from about 80 centipoise to about 300 centipoise; and most preferably, a high shear rate viscosity from about 80 centipoise to about 170 centipoise.

When dispensing these relatively viscous liquids the pump device 20 should have liquid paths or passages that are preferably large enough to avoid pressure drops where such pressure drops are undesirable. Liquid paths such as the inlet passage 23, the pump chamber 28, and the discharge passage 27 are all preferably substantially cylindrical or tubular in shape and have inner diameters that are preferably equal to or greater than about 0.125 inches. Constriction of these liquid paths can result in a slow recharge rate of the pump device 20 following actuation.

As the operating principles of pump devices 20 themselves are generally well-known, a brief overview of their operation with respect to the spray delivery systems 10 according to the present invention is provided. To actuate the spray delivery system 10 and start a dispensing cycle, the trigger 24 is actuated manually, by finger pressure, increasing the liquid pressure within the pump chamber 28 causing the liquid to become a pressurized liquid. The pressurized liquid enters the discharge passage 27. The pressurized liquid travels through the discharge passage 27 to the slotted spray nozzle 40 (which is depicted in greater detail in the succeeding Figures), and on through the elongated orifice 42 where it is dispensed in the form of a dispersed spray. Once the pump device 20 reaches the end of its travel (or the trigger 24 is released during an incomplete dispensing cycle), pressure within the pump chamber 28 diminishes and liquid flow out of the elongated orifice 42 ceases. If the trigger 24 is then released, a spring force from the spring 15 returns the trigger 24 to its initial position (thereby drawing liquid up through the inlet passage 23 and into the pump chamber 28 of the pump device 20), where it is ready for the next dispensing cycle.

Manually operated pump devices 20 used in the present invention can have a transient hydraulic pressure dispensing cycle. This transient hydraulic pressure is generated during actuation since the pressure tends to gradually build up during the initial movement of the trigger 24 by the operator's fingers upon applying the force to dispense. This pressure reaches a maximum during initiation of the dispensing cycle, somewhere during the travel of the trigger 24 toward the end of the actuation stroke and thereafter rapidly decreases once the end of the actuation stroke is reached. The maximum hydraulic pressure obtains a magnitude greater than about 30 psi; preferably, the maximum hydraulic pressure can obtain a range from about 30 psi to about 200 psi; more preferably, the maximum hydraulic pressure is from about 60 psi to about 120 psi; most preferably, the maximum hydraulic pressure is about 100 psi. When the preferred force to dispense is applied at an actuation rate of from about 3 inches per second to about 4 inches per second, the time required to achieve this maximum hydraulic pressure is preferably from about 0.4 to about 1 second; more preferably, this maximum hydraulic pressure is reached at from about 0.5 to about 0.8 seconds. The liquid sheet that is being expelled from the slotted spray nozzle 40 during this transient pressure dispensing cycle is expanding and contracting in width, respectively with these pressure variations. Generally, under steady state (constant pressure/constant flow) pressure conditions, liquids dispensed from typical fan slot type spray nozzles, made from rigid materials, have thickened sheet edges that form at the outer edges of the spray pattern. However, the expanding and contracting spray pattern, created by the transient pressure nature of this spray delivery system 10, ensures that the thickened sheet edges do not impinge on the surface to be coated at the same locations throughout the dispensing cycle. Thus, the occurrence of areas of high product concentration on the surface to be coated is reduced or eliminated when utilizing this spray delivery system 10. This helps to reduce the total quantity of liquid required to properly coat a surface with a uniform and evenly distributed layer of liquid product.

Since the spray delivery systems 10 of the present invention can be utilized with a wide variety of liquids it is preferable that the spray delivery system 10 be refillable. Thus, a cap 25 (as seen in FIG. 2) is preferably provided for removably connecting the pump device 20 to the container 30. To enable the pump device 20 to be removed from the container 30, mutually compatible threads can be provided on both the cap 25 and the container 30. Various other methods of connecting the pump device 20 and the cap 25 to the container 30 can be utilized, for example, snap fit, twist lock, and the like. When the pump device 20 is removed from the container 30, the container 30 can be refilled with liquid product. Additionally, for ease of use and less messy operation during refilling of the container 30, the container 30 can have an enlarged opening or neck finish which will allow the liquid product to be easily poured into the container 30 from a storage carton. This also enables the container 30 to be refilled in a shorter period of time since more liquid can pass through the enlarged opening. Preferably the enlarged opening has a diameter from between about 28 mm to about 53 min. When the container 30 utilizes an enlarged opening, the cap 25 will be in the form of a transition piece (not shown) adapted to fit both the enlarged opening of the container 30 and also the pump device 20. Preferably, the container 30 can be blow molded using any number of well known materials, for example, high-density polyethylene (HDPE), polyethylene terepthalate (PET), or the like.

Figure 3:
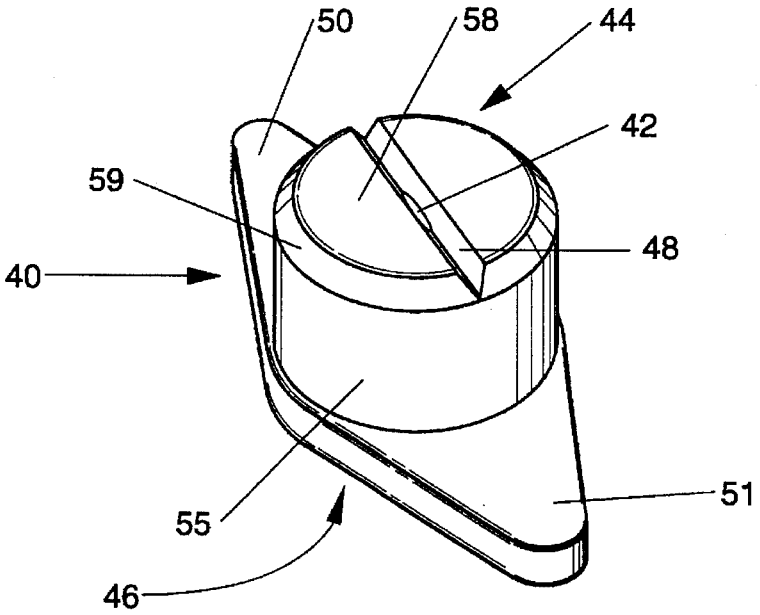
FIG. 3 is an enlarged perspective view of the spray nozzle of FIG. 1.

FIG. 3 shows an enlarged perspective view of the slotted spray nozzle 40 for use with this spray delivery system 10. The slotted spray nozzle 40 includes a housing 55, which is preferably substantially cylindrical in shape, having an inlet side 46 and an exit side 44. The housing 55 has a nozzle face 58 with a chamfer 59 located on the perimeter of the nozzle face 58 at the exit side 44.

Figure 4:
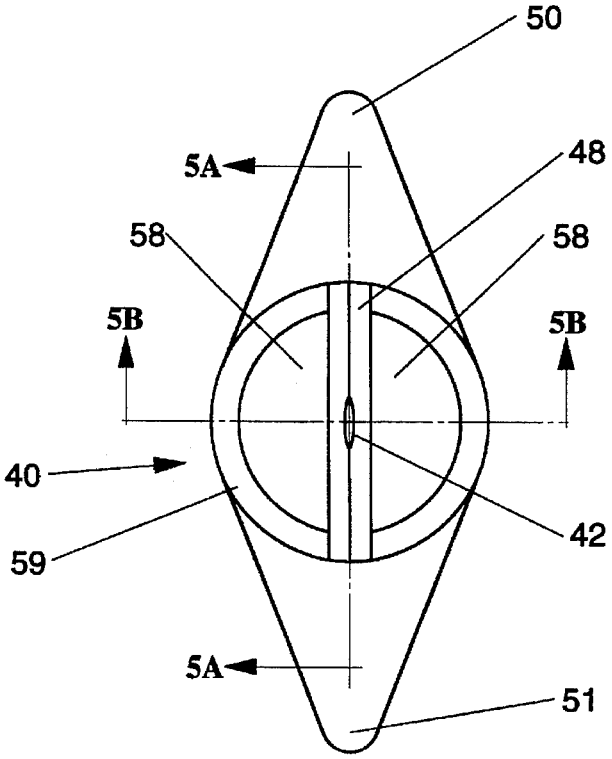
FIG. 4 is an enlarged plan view of the spray nozzle of FIG. 3.

In reference to FIG. 4, the slotted spray nozzle 40 is seen with the elongated orifice 42 in a centrally located position and preferably being substantially elliptical in shape. The elongated orifice 42 can also be in the form of, for example, a slot, slit, notch, or the like, so long as the opening is substantially elongated. The major dimension of the elongated orifice 42, as seen in FIG. 4, is the largest of the dimensions of the elongated orifice 42. The minor dimension of the elongated orifice 42 is the length of the line perpendicular to and bisecting the major dimension. The elongated orifice 42 preferably, has a major dimension of from about 0.03 inches to about 0.05 inches; and most preferably, the major dimension is from about 0.035 inches to about 0.041 inches. The elongated orifice 42 preferably, has a minor dimension of from about 0.008 inches to about 0.017 inches; and most preferably, the minor dimension is from about 0.010 inches to about 0.012 inches. The ratio of the major dimension to the minor dimension of an item is known as the aspect ratio. The aspect ratio of the elongated orifice 42 preferably, is from about 3 to about 4; and more preferably, is from about 3.4 to about 3.8.

Figure 5A:
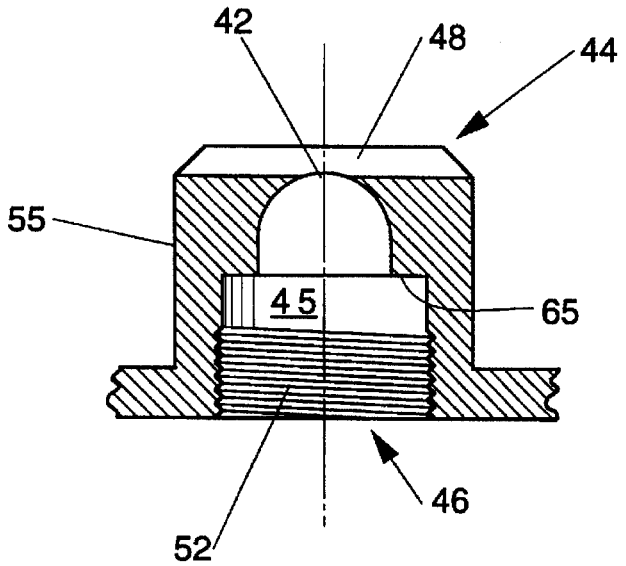
FIG. 5A is a cross-section of the spray nozzle taken along line 5A—5A of FIG. 4.
Figure 5B:
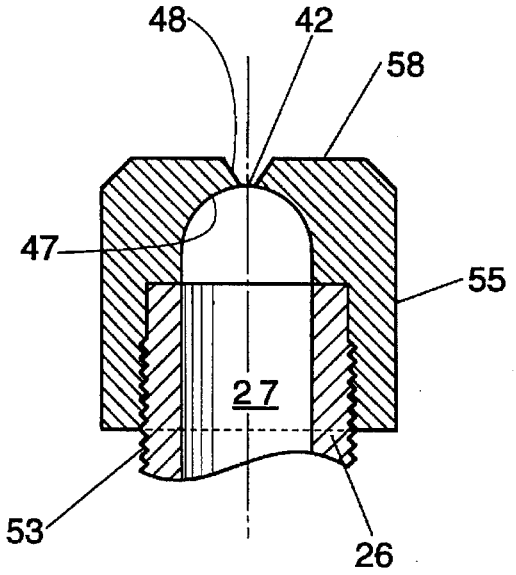
FIG. 5B is a cross-section of the spray nozzle taken along line 5B—5B of FIG. 4 and showing a portion of the discharge passage.
Figure 11A:
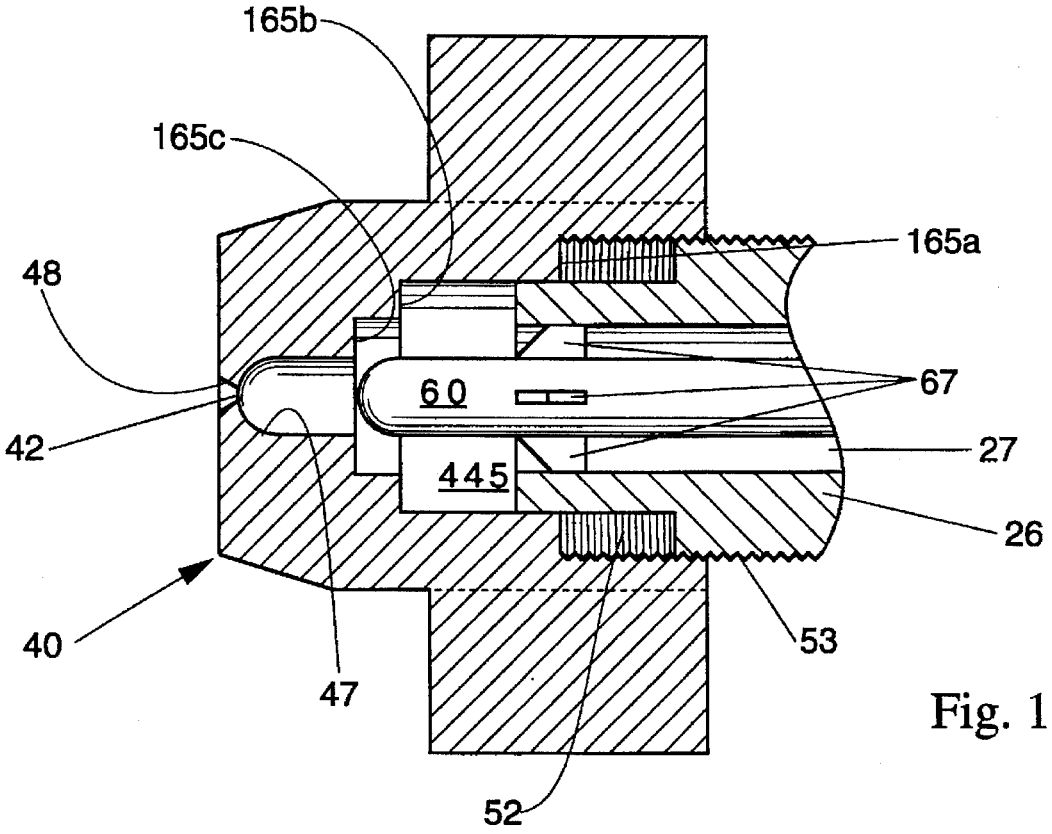
FIG. 11A is a cross-section similar to FIG. 5B of a seventh alterative spray nozzle having a post, shown in the retracted position.
Figure 11B:
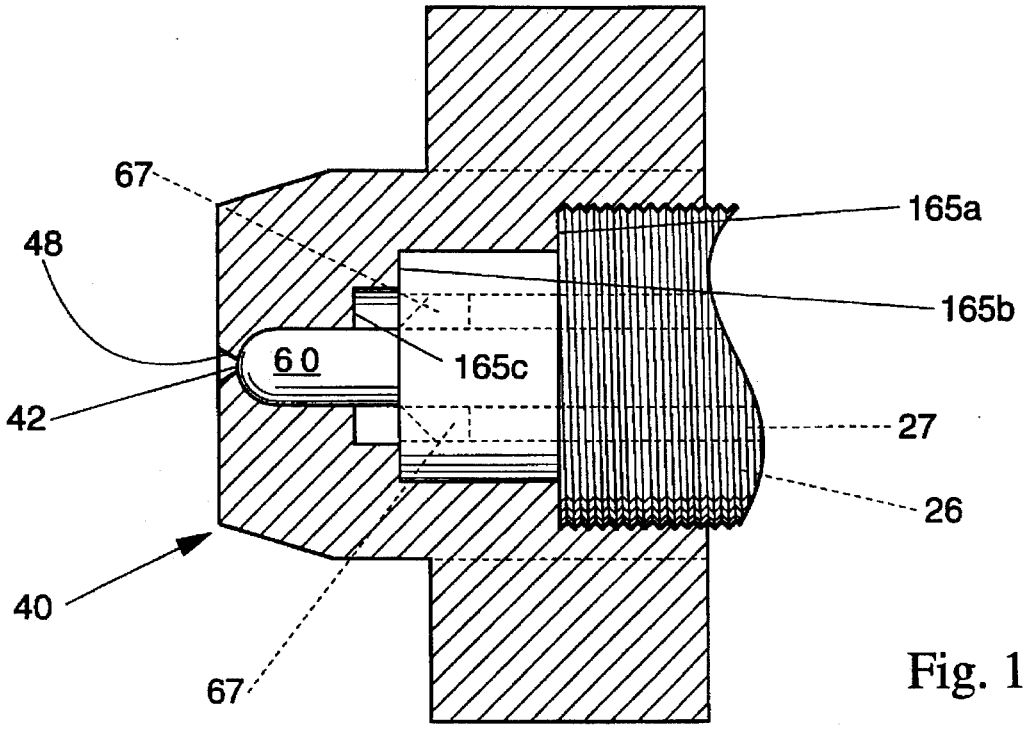
FIG. 11B is a view of the seventh alternative spray nozzle of FIG. 11A, shown in the closed position.

In reference to FIGS. 5A and 5B, a cross-section of the slotted spray nozzle 40 is seen. The housing 55 has an internal recess 45 extending through the inlet side 46 that terminates in an elongated orifice 42 at the exit side 44. The internal recess 45 preferably has a dome shaped interior surface 47 therein and the exit side 44 also has a groove 48 therein which intersects with the internal recess 45 and the interior surface 47 to form the elongated orifice 42. This groove 48 is cut or formed into the nozzle face 58 of the housing 55. The slotted spray nozzle 40 having the internal recess 45 is attached in liquid communication to a distal end of the discharge passage 27 such that the liquid passing through the discharge passage 27 flows through the slotted spray nozzle 40 and converges toward the elongated orifice 42 and is dispensed therefrom in a dispersed spray. The slotted spray nozzle 40 includes the internal recess 45 preferably, having a shoulder 65 located between the exit side 44 and the inlet side 46. The discharge tube 26 abuts the shoulder 65 when the slotted spray nozzle 40 is properly connected to the pump device 20 such that the elongated orifice 42 is in liquid communication with the pump device 20. The internal recess 45 is used for conducting the liquid from the discharge passage 27 to the elongated orifice 42. Preferably, the portion of the internal recess 45 extending from the inlet side 46 is cylindrical in shape and has an inner diameter that is spaced inwardly at the shoulder 65 and thereafter the internal recess 45 transitions to the dome shaped interior surface 47 at the exit side 44. The portion of the internal recess 45 that extends between the shoulder 65 and the dome shaped interior surface 47 has an inner diameter that is preferably, from about 0.02 inches to about 0.1 inches; more preferably, from about 0.03 inches to about 0.06 inches; and most preferably, about 0.04 inches in length. Optionally, (as seen in FIG. 11A and 11B) multiple shoulders 165*a*, 165*b*, and 165*c* can be utilized to reduce the inner diameter of the internal recess 445 in a step wise fashion.

In the configuration seen in FIGS. 5A and 5B, internal threads 52 are included in the internal recess 45 at the inlet side 46 of the slotted spray nozzle 40. These internal threads 52 engage with external threads 53 located on the distal end of the discharge tube 26 in order for the slotted spray nozzle 40 to be threadably connected to the discharge tube 26. Various thread sizes as well as various other mechanical methods of connecting the slotted spray nozzle 40 to the discharge tube 26 can be used. For example, an alternative method of connecting the discharge tube 26 to the slotted spray nozzle 40 can be a snap fit type connection.

The interior surface 47 is preferably dome shaped, that is, resembling or shaped like a substantially hemispherical vault or in the form of a portion of a substantially spherical shape. The interior surface 47 most preferably has a hemispherical diameter that is substantially equal to the inner diameter of the internal recess 45. The exit side 44 has a groove 48 cut therethrough which intersects the interior surface 47 forming the elongated orifice 42. During a dispensing cycle of this spray delivery system 10 it is the transition of the internal recess 45 to the dome shaped interior surface 47 that causes the convergence of the liquid streamlines toward the elongated orifice 42 at high stream velocities when the liquid is forced through the slotted spray nozzle 40. The shape of the elongated orifice 42 forces the liquid streamlines to form a flat liquid sheet oriented parallel to the major dimension of the elongated orifice 42 upon exiting or being dispensed from the confines of the slotted spray nozzle 40. External to the slotted spray nozzle 40 the liquid sheet forms ligaments and thereafter droplets which disperse or disintegrate into an atomized or dispersed spray. The dispersed droplets of liquid can be finely dispersed, such as an atomized spray, or even more coarsely dispersed representing larger droplets of liquid. When this dispersed spray contacts the surface intended to be coated with the liquid, a thin and uniform coating of liquid is produced.

While a variety of slotted spray nozzles 40 can be suitable for use in the spray delivery system 10 of the present invention, the slotted spray nozzle 40 resembles the type of nozzle configuration typically used in industrial sprayer applications. Slotted spray nozzles 40 of this general type have a similar orifice configuration as commercially available versions sold by Lechler, Inc. under the model No. 652.276 having the trade name "mini fan". An alternative embodiment of the slotted spray nozzle 40 can be fabricated as an assembly by machining threads onto the model No. 652.276 "mini fan" nozzle and then connecting a bushing or sleeve to that nozzle such that it is attached in liquid communication to the discharge passage 27 of the pump device 20. While the slotted spray nozzle 40 can be constructed as an assembly, the preferred embodiment is a unitary construction or fabrication resulting in a one piece slotted spray nozzle 40.

In particular, the spray delivery system 10 and the slotted spray nozzle 40 according to the present invention can be fabricated or manufactured in any suitable fashion. A presently preferred method of forming the slotted spray nozzle 40 is by injection molding. In one embodiment, this slotted spray nozzle 40 can be molded or machined from any number of well known rigid materials, such as, polypropylene (PP), polystyrene (PS), polytetrafluoroethylene (PTFE), polyvinyl chloride (PVC), polyvinylidenefloride (PVDF), aluminum, brass, steel, or other metals, or the like.

Figure 6:
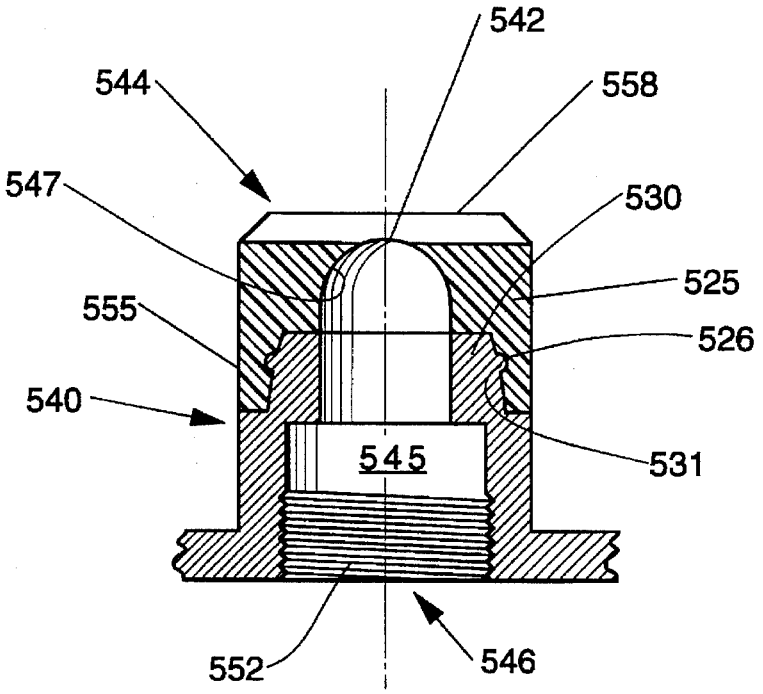
FIG. 6 is a cross-section similar to FIG. 5A of a first alternative spray nozzle.

In an even more preferable embodiment, the slotted spray nozzle 40 can be made out of an elastomeric or rubber-like material that resiliently distorts or flexibly expands allowing solid particles having particle dimensions larger than the minor dimension of the elongated orifice 42 to pass through the slotted spray nozzle 40 thereby reducing the likelihood of clogging. Referring now to FIG. 6, a first alternative slotted spray nozzle 540 is shown including a housing 555 having an inner layer or first segment 530 at the inlet end 546 and an outer layer or second segment 525 at the exit end 544. The inner layer 530 is preferably made of a rigid material although it can be constructed of an elastomeric material. The outer layer 525, preferably made of an elastomeric material, includes the elongated orifice 542 and preferably includes the nozzle face 558. The inner layer 530 includes the internal recess 545 having internal threads 552 which mate with the external threads 53 on the distal end of the discharge tube 26. The inner layer 530 is connected to the outer layer 525 preferably using a snap fit engagement. The snap fit engagement is created or formed by a circumferential rib 531 extending radially outward from the inner layer 530 which engages a circumferential channel 526 that is formed into the outer layer 525. Since the outer layer 525 is made of an elastomeric material, it can resiliently distort allowing the channel 526 and the rib 531 to engage in a snap fit manner.

Figure 7:
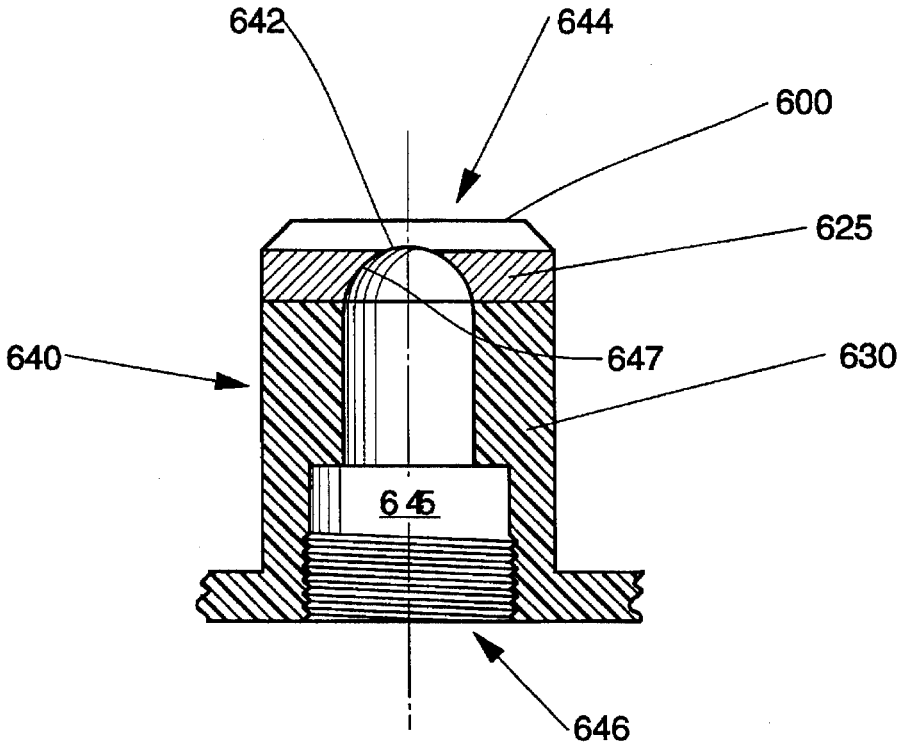
FIG. 7 is a cross-section similar to FIG. 5A of a second alternative spray nozzle.

Referring now to a second alternative slotted spray nozzle 640, as seen in FIG. 7 the forward layer or second segment 625, preferably made of an elastomeric material, is in the form of a nozzle tip 600 at the exit side 644 of the slotted spray nozzle 640 and the rear layer or first segment 630 extends from the nozzle tip 600 to the inlet side 646. The second segment 625 includes the elongated orifice 642 and preferably the portion of the internal recess 645 having the dome shaped interior surface 647. Thus, the exit side 644 having the elongated orifice 642 formed therein is constructed of an elastomeric material which substantially reduces the likelihood of clogging during use. The forward layer 625 preferably is made integral with, affixed to, or bonded to the rear layer 630. Preferably, these layers are made integral by, for example, co-injection molding in one piece or by co-injection molding in two separate layers or even by dual-component injection molding. Alternatively, the slotted spray nozzles 540 and 640 can be constructed of separate parts affixed or fastened together using various other methods without detracting from the invention disclosed herein. The forward layer 625 and the rear layer 630 can be fastened together using, for example, an adhesive, threaded engagement, mechanical fastener, or the like.

Figure 8:
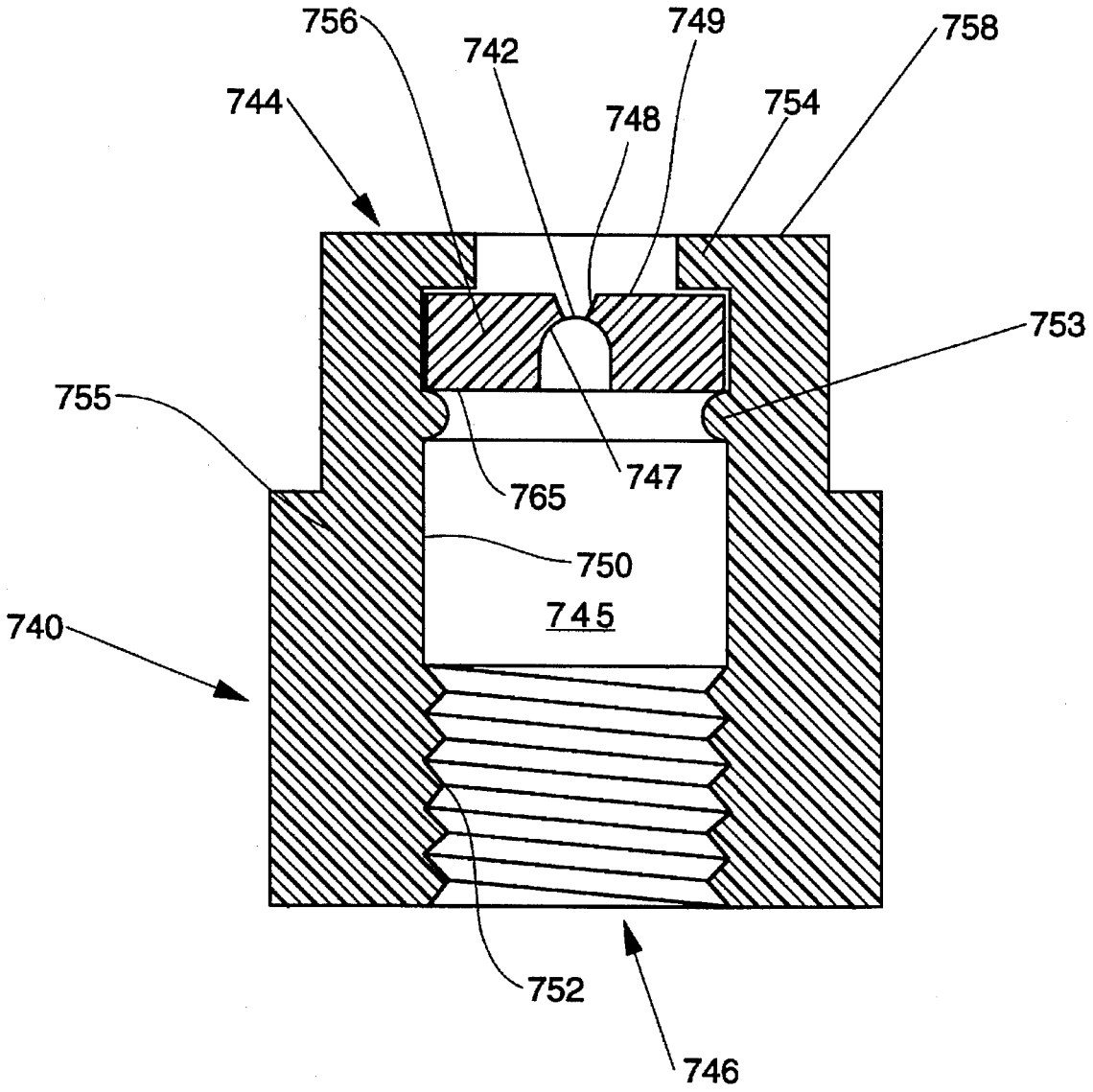
FIG. 8 is an enlarged cross-section similar to FIG. 5B of a third alterative spray nozzle suitable for use with the present invention.

Referring now to FIG. 8, a third alternative slotted spray nozzle 740 is shown including a housing 755 and an insert 756. The insert 756 having an elongated orifice 742 formed therein and the side of the insert 756 opposite the elongated orifice 742 functions as a shoulder 765. The internal recess 745 further including an interior surface 750 having a first engagement rim 754 located at the exit side 744 of the housing 755. The first engagement rim 754 extending radially inward from the interior surface 750 and terminating at a location spaced radially outboard of the elongated orifice 742. The insert 756 being maintained within the internal recess 745 by this first engagement rim 754. The insert 756 being constructed of an elastomeric material which allows the elongated orifice 742 to resiliently distort thereby substantially reducing the likelihood of clogging during use. Alternatively, a second engagement rim 753 can be provided at a position spaced axially toward the inlet end 746 and away from the first engagement rim 754, preferably a distance about equivalent to the axial thickness of the insert 756. The second engagement rim 753 extends radially inward from the interior surface 750 and terminates at a location spaced radially outboard of the domed surface 747. The first and second engagement rims 754 and 753 form a circumferential slot which can cooperate with the resilient nature of the elastomeric material of the insert 756 to form a snap fit engagement between the insert 756 and the housing 755.

Elastomeric materials as used herein can, for example and not by way of limitation, belong to one of the following categories: thermoplastic elastomers (TPEs), thermoset elastomers, ethylene/octene (or butene or hexene, etc.) copolymers, ethylene/vinyl acetate (EVA) copolymers, and/or blends of these categories. More concise descriptions and examples of these categories of elastomeric materials follow.

In particular, TPEs are defined by ASTM D1556 as: "a family of rubber-like materials that, unlike conventional vulcanized rubber, can be processed and recycled as thermoplastic materials", and are classified into three major categories: 1) block copolymers; 2) rubber/thermoplastic blends; and 3) elastomeric alloys (EAs). More specifically, block copolymers are, for example, styrenic rubber (e.g. Kraton® from Shell Chemical), copolyester (e.g. Hytrel® from Du Pont), polyurethane (e.g. Texin® from Bayer), and polyamide (e.g. Pebax® from Atochem). Rubber/thermoplastic blends which can also be referred to as elastomeric polyolefins or TEOs are, for example, blends of ethylene-propylene-diene-monomer (EPDM) rubber and polyolefin (e.g. Vistaflex® from Advanced Elastomer Systems, L.P.) and blends of nitrile rubber and PVC (e.g. Vynite® from Dexter). EAs are systems with dynamically vulcanized elastomers (EPDM, nitrile, natural, and butyl rubber) in the presence of a thermoplastic matrix (preferably PP), for example, Santoprene® from Advanced Elastomer Systems, L.P. More detailed information about TPEs can be found in the scientific literature, for example see: M. T.

Payne, and C. P. Rader, "Thermoplastic Elastomers: A Rising Star" in *ELASTOMER TECHNOLOGY HANDBOOK,* N. P. Cheremisinoff, (ed.), CRC Press, Boca Raton, Fla. (1993); and Legge, N. R., et al., (eds.), *THERMOPLASTIC ELASTOMERS,* Hanser Pub., New York (1987).

Some typical examples of thermoset elastomers are, for example, Silastic® silicone elastomers from Dow Coming, Viton® fluoroelastomers from Du Pont, and Buna rubbers from American Gasket and Rubber Co. Additionally, some examples of ethylene copolymers are, for example, the resins Engage® from Dow (these resins are copolymers of ethylene and octene prepared using metallocene technology) and Flexomer® from Union Carbide (with butene and/or hexene). Furthermore, some examples of EVA copolymers are, for example, the resins Ultrathene® from Quantum and ELVAX® from Du Pont.

Other classifications of elastomeric materials are based on material properties rather than physical or chemical compositions. Some of the relevant material properties are hardness, Young's (tensile) and flexural moduli, and tensile and flexural strengths. Material hardness is measured according to ASTM D2240 or ISO 868 standards. Hardness scales Shore A and D are used for these elastomeric materials, with scale D denoting harder materials. The standards for the tensile tests are ASTM D412 (ISO 37) or ASTM D638 (ISO R527) and for the flexural tests are ASTM D790 (ISO 178).

Preferably, the hardness of the elastomeric material used in the construction of the slotted spray nozzle 40 is between about 40 Shore A to about 60 Shore D, and more preferably, between about 65 Shore A to about 50 Shore D, and most preferably, between about 80 Shore A to about 40 Shore D. The flexural modulus of the elastomeric material used in construction of the slotted spray nozzle 40 is preferably, between about 1,000 psi (6.9 MPa) to about 25,000 psi (124.1 MPa), and more preferably, between about 2,000 psi (13.8 MPa) to about 15,000 psi (69.0 MPa), and most preferably, between about 3,000 psi (20.7 MPa) to about 9,000 psi (41.4 MPa). A rigid material as used herein is preferably a material with hardness above about 60 Shore D.

Any of these or various other or similar blends of elastomeric materials can produce a slotted spray nozzle 40 that is capable of spraying solids laden liquids without any significant or permanent clogging incidents even when the liquids dispensed contains suspended solid particulates of sizes slightly larger than the minor dimension of the elongated orifice 42. Solid particulates of sizes slightly larger than the minor dimension are preferably particulates of sizes between about the size of the minor dimension of the elongated orifice 42 to about the size of the inner diameter of the internal recess 45. The minor dimension of the elongated orifice 42 is measured in the at rest condition, not at a time when liquid is passing through the elongated orifice 42. For example, when dispensing a solids laden liquid using an elastomeric material having a hardness from between about 30 Shore D to about 40 Shore D the slotted spray nozzle 40 experiences about 1 temporary clog per 10,000 cycles. As used herein, a temporary clog is when the slotted spray nozzle 40 recovers or unclogs itself in less than about 15 subsequent cycles.

The ability of the slotted spray nozzle 40 made with an elastomeric material to spray liquids with suspended solid particulates or agglomerates of solid particulates, formed either behind the slotted spray nozzle 40 or in the suspending liquid, is attributed to the elastomeric nature of the slotted spray nozzle 40 and more particularly, to the elastomeric nature of the elongated orifice 42 or the nozzle face 58 which is the part of the slotted spray nozzle 40 that surrounds the elongated orifice 42. It is believed that, during a dispensing cycle (i.e., under dynamic conditions), a solid particulate with a maximum dimension larger than the minor dimension of the elongated orifice 42, measured at rest (i.e., under static conditions), can initially temporarily clog the elongated orifice 42, thus causing a pressure increase behind the obstruction, which in turn causes the elongated orifice 42 to resiliently distort and/or expand whereby the minor dimension of the elongated orifice 42 is temporarily increased enough to allow the solid particulate to pass through and be dispensed along with the liquid in a dispersed spray. The elongated orifice 42 in the slotted spray nozzle 40 constructed of a rigid material is not able to resiliently distort like the elastomeric material and thus when a liquid with large amounts of suspended solid particulates or agglomerates of solid particulates is used, the slotted spray nozzle 40 can possibly become clogged. This likelihood of clogging, however, is substantially reduced when compared to dual impingement type systems presently available and when dispensing the same or similar solids laden liquids.

When dispensing liquids from the slotted spray nozzle 40 constructed with an elastomeric material a substantially circular shaped spray pattern is achieved as a result of the distortion of the elongated orifice 42 under dynamic conditions. This substantially circular spray pattern preferably has an aspect ratio of less than about 1.6, and more preferably, has an aspect ratio between about 1.2 to about 1.6. When a rigid material is used to make the slotted spray nozzle 40, an asymmetrical or fan shaped spray pattern is produced when liquid is dispensed from this spray delivery system 10. Generally, this fan shaped spray pattern consists of dispersed droplets of liquid arranged such that a transverse cross-section of the fan shaped spray pattern is elongated, elliptical, or oblong in shape. The fan shaped spray pattern generated when liquid is dispensed from the slotted spray nozzle 40 constructed from a rigid material preferably has an aspect ratio of greater than about 1.6, and more preferably the aspect ratio is between about 1.6 to about 3. These aspect ratios are for spray patterns generated from slotted spray nozzles 40 constructed of elastomeric materials and of rigid materials both having substantially identical dimensions and the aspect ratios of the spray patterns are determined by measurement of the diameters of the spray patterns at a distance of about 8 inches from the elongated orifice 42.

Furthermore, the chemical and physical compositions of the material as well as its material properties need to be considered in selecting a material for a slotted spray nozzle 40, especially when the liquid to be dispensed can chemically attack the material (e.g. dissolves the material or is strongly absorbed into the material) or can chemically react with the material (e.g. contamination of the liquid due to extraction of components from the material). If there is no such strong chemical interaction between the material and the liquid then the material's physical properties alone need to be considered in selecting a proper material for the slotted spray nozzle 40. One example of a combination of a liquid and an elastomeric material that can have a strong interaction is cooking oil and either styrenic rubbers, EAs, and/or TEOs. These elastomeric materials contain plasticizers that can be extracted into the cooking oil, thereby contaminating the cooking oil. It is for this reason that these particular elastomeric materials do not comply with the appropriate U.S. FDA regulation 21 CFR §177.2600 (for "rubber articles intended for repeated use") and should not be used in a slotted spray nozzle 40 used for atomizing cooking oils. Other pertinent U.S. FDA regulations are, for example: 21 CFR §177.1210 for "closures with sealing gaskets for food containers"; 21 CFR §177.1350 for "ethylene/vinyl acetate copolymers"; 21 CFR §177.1520 for "olefin polymers"; 21 CFR §177.1590 for "polyester elastomers"; and 21 CFR §177.1810 for "styrene block copolymers".

Since a fan shaped spray pattern is generated when liquid is dispensed from a slotted spray nozzle 40 made of a rigid material, it is convenient to aid the operator by indicating the alignment or orientation of the fan shaped spray pattern. This can be accomplished by optionally adding one or more visual or visual/functional features, such as the visual alignment tabs 50, 51 seen in FIG. 4 on the slotted spray nozzle 40. As seen in FIGS. 1, 3 and 4, the visual alignment tabs 50, 51 are preferably oriented such that they are aligned with the major axis of the elongated orifice 42. When the visual alignment tabs 50, 51 are in a vertical orientation, likewise the major axis of the elongated orifice 42 will be in a vertical orientation and thus, the liquid will be dispensed from the slotted spray nozzle 40 such that the fan shaped spray pattern is delivered in a predictable orientation. Similarly, when the slotted spray nozzle 40 is rotated the operator will still be able to predict the orientation of the emerging fan shaped spray pattern. Therefore the operator is able to easily and effectively apply a thin, uniform coating of liquid onto the surface to be coated.

Figure 9:
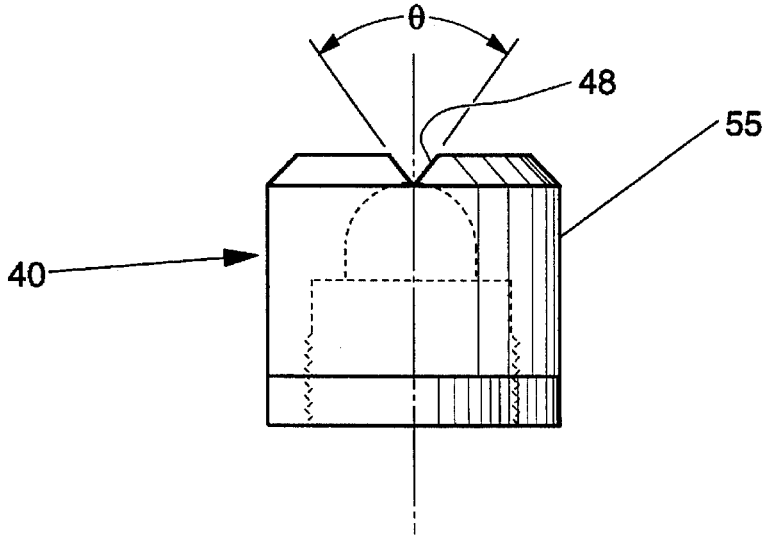
FIG. 9 is an enlarged elevational view of the spray nozzle of FIG. 3 showing the V-shaped groove.

FIG. 9 depicts a "V-shaped" groove 48 on the slotted spray nozzle 40. This "V-shaped groove 48 has an angle θ (Theta), which represents the average included angle of the groove 48 measured along the major dimension of the elongated orifice 42. As defined herein, the angle θ will of necessity be some value from between about 0° to about 180°, with the 0° representing a groove 48 with parallel sides and 180° representing no groove 48 at the exit side 44. The angle θ for use in the slotted spray nozzle 40 of the present invention preferably, is between about 20° to about 90°; more preferably, between about 30° to about 50°; and most preferably has a range of between about 41° to about 44° when used with a cooking oil. It has been found that a triangular prismatic or "V-shaped" groove 48 and a hemispherical interior surface 47 in liquid communication with a cylindrical liquid inlet such as the internal recess 45 work well to produce the liquid sheet which disintegrates into a dispersed spray.

Figure 10A:
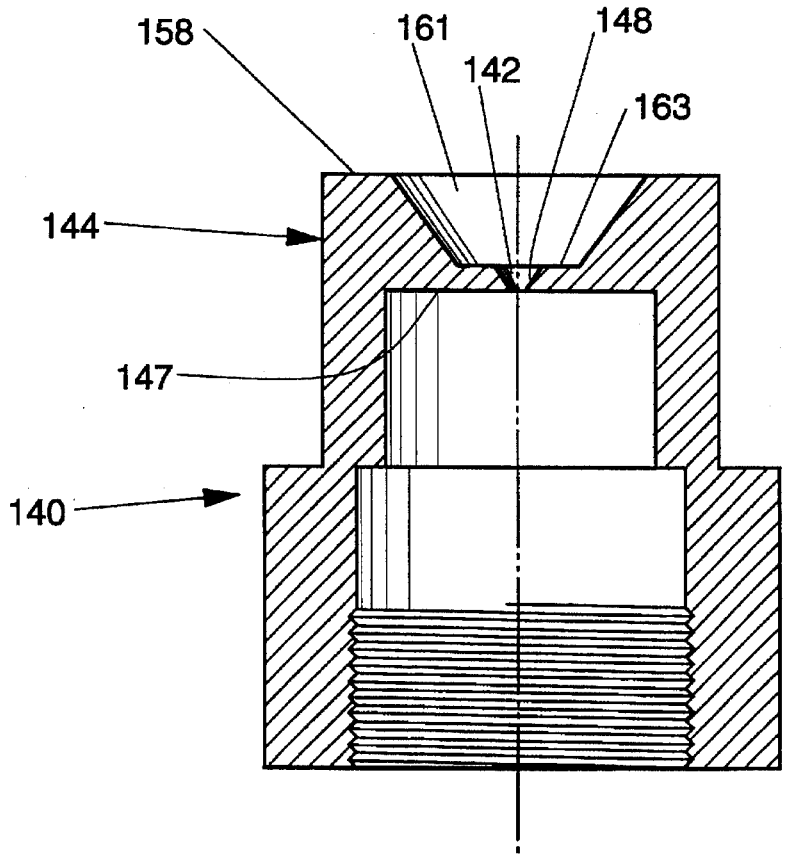
FIG. 10A is an enlarged cross-section similar to FIG. 5B of a fourth alternative spray nozzle suitable for use with the present invention.

In a fourth alternative embodiment of the slotted spray nozzle 140 seen in FIG. 10A, a cavity 161 is located at the exit side 144. The cavity 161 extends from the nozzle face 158 to the cavity bottom 163 which is spaced axially from interior surface 147. The groove 148 cut through or formed in the cavity bottom 163 intersects with the interior surface 147 forming the elongated orifice 142. This groove 148 can be, for example, in the form of a slot or even a substantially elongated frusta-conical shape. The cavity 161 is cup shaped and provides a recessed area around the elongated orifice 142. This cavity 161 can be of various geometric shapes, for example, concave, frusta-conical, cylindrical, rectangular, and the like. The cavity 161 functions as a basin and helps to prevent excess dripping of liquid from the slotted spray nozzle 140 after completion of a dispensing cycle. FIG. 10A additionally depicts an alterative configuration for the interior surface 147 which is shown in a substantially flat configuration and can be, for example, constructed of a flexible membrane or a substantially resilient material such as an elastomeric material. While the preferred configuration of the interior surface 147 is substantially dome shaped, other configurations of the interior surface 147 can also be utilized which provide for liquid convergence toward the elongated orifice 142. For example, the interior surface 147 can also be substantially conical, concave, curved, frusta-conical, tapered, and the like, or any combination of these configurations.

Figure 10B:
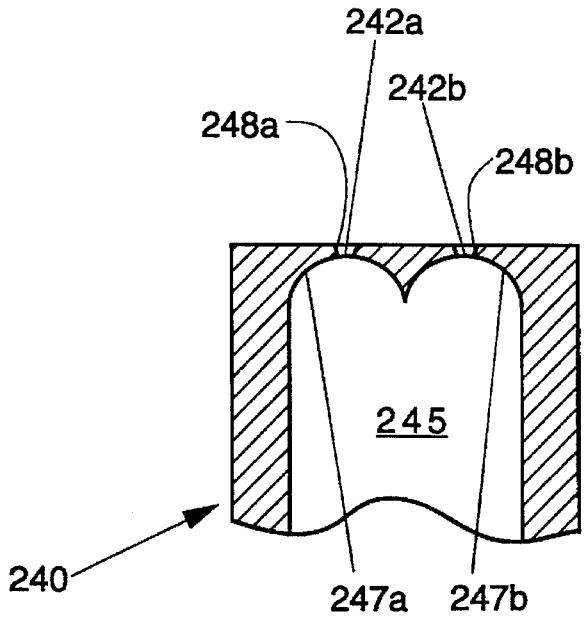
FIG. 10B is an enlarged cross-section similar to FIG. 5B of a fifth alterative spray nozzle having two elongated orifices suitable for use with the present invention.
Figure 10C:
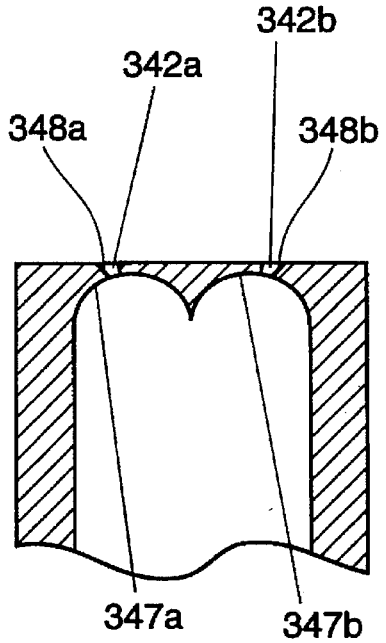
FIG. 10C is an enlarged cross-section similar to FIG. 5B of a sixth alterative spray nozzle having two oriented elongated orifices suitable for use with the present invention.

The fifth alternative embodiment of slotted spray nozzle 240 seen in FIG. 10B has an internal recess 245 with dual dome shaped interior surfaces 247*a* and 247*b*. Two grooves 248*a* and 248*b* are also provided which, arranged together with the interior surfaces 247*a* and 247*b*, form two elongated orifices 242*a* and 242*b*. These dual elongated orifices 242*a* and 242*b* allow dispensing of the liquid in a twin spray pattern. The grooves 248*a* and 248*b* are centered in the dome shaped interior surfaces 247*a* and 247*b* of the embodiment seen in FIG. 10B. In FIG. 10C the grooves 348*a* and 348*b* are offset from the central location on the dome shaped interior surfaces 347*a* and 347*b*. The alignment or placement of the grooves 348*a* and 348*b* along with variations in the angle θ can allow the spray pattern to be tailored so that a wider area of coverage can be obtained. Additionally, the spray patterns exiting from the individual elongated orifices 342*a* and 342*b* can overlap or be directed to different locations on a surface to be coated, providing for an improved distribution of the dispersed spray on the surface. Although only two elongated orifices 342*a* and 342*b* are seen in FIG. 10C, additional elongated orifices 342*a* and 342*b* can be provided.

The spray delivery system 10 of the present invention can be used to dispense virtually any liquid product in a more controlled and more consistent fashion. However, it has been found to be particularly advantageous to use the spray delivery system 10 for dispensing viscous and/or solids laden liquids. Examples of such liquids include, but are not limited to: cooking oils, pan coatings, flavored oils, liquid flavor enhancers, mouthwashes, dyes, hair sprays, lubricating oils, liquid soaps, cleaning solutions, laundry detergents, dishwashing detergents, pre-treaters, hard surface cleaners, paints, polishes, window cleaners, cosmetics, rust preventatives, surface coatings, and the like.

The solids laden liquids suitable for use in the present invention can have a substantial amount of solid materials suspended in them, preferably, up to about 3% by weight of solid particulate; more preferably, up to about 6% by weight of solid particulate; and most preferably, up to about 10% by weight of solid particulate material. When the slotted spray nozzle 40 is constructed of a rigid material, the particle dimensions preferably are less than about the minor dimension of the elongated orifice 42. When the slotted spray nozzle 40 is constructed of an elastomeric material, the particle dimensions are preferably less than about the inner diameter of the internal recess 45 at the dome shaped interior surface 47. The level of solids and the size of the solid particles that can be contained or suspended in the solids laden liquid can vary from liquid to liquid and it is important to control the amount and size of the solid particles contained in the liquid in order to reduce the likelihood of clogging of the slotted spray nozzle 40.

Preferred liquids for use in the spray delivery system 10 are vegetable oil based cooking sprays. These products are often formulated with a large percentage (from about 80 to 100% by weight) of vegetable oil and are relatively viscous and dan also be solids laden. Typically, these products include minor percentages of lecithin, emulsifiers and flavor enhancers along with other ingredients and solids, for example, flavor solids, fat crystals, salts, or other solid particulate material used to enhance the liquid product's performance, see for example, U.S. Pat. No. 4,385,076, issued May 24, 1983 to Crosby, and U.S. Pat. No. 4,384,008, issued May 17, 1983 to Millisot.

A particularly preferred cooking oil which has performed well with the spray delivery system 10 of the present invention comprises vegetable oil, salt particles, lecithin, solid flavor particles, carotene and other liquid flavors; wherein from about 95% to about 100% of the flavor particles in the unagglomerated state have a maximum particle dimension of less than about 425 microns (through U.S. 40 mesh); from about 15% to about 40% of the particles have a maximum particle dimension greater than about 75 microns (on U.S. 200 mesh); from about 30% to about 50% of the particles have a maximum particle dimension greater than about 53 microns (on U.S. 270 mesh); and from about 35% to about 60% of the particles have a maximum particle dimension less than about 38 microns (through U.S. 400 mesh), and wherein about 99.9% of the salt particles in the unagglomerated state have a maximum particle dimension less than about 25 microns and the weighted average particle dimension is less than about 10 microns. As used herein the term particle dimension refers to the over-all width or diameter of the particle.

The slotted spray nozzle 40 can optionally have a manual closure or cleaning feature seen in FIGS. 11A and 11B. In this embodiment, a post 60 is affixed to the distal end of the discharge passage 27 so as to allow the liquid to flow through the discharge passage 27 in an open position (seen in FIG. 11A). The post 60 is connected to the discharge tube 26 by struts 67 that extend radially outwardly from the post 60. This post 60 is used to help shut off the elongated orifice 42 when the slotted spray nozzle 40 is in the non-operating or closed position (seen in FIG. 11B). The post 60 cooperates with the interior surface 47 such that the slotted spray nozzle 40 is moveable between an open position and a closed position in order to shut off or close the elongated orifice 42. Preferably the post 60 has a contour and size that is substantially the same as the interior surface 47. This post 60 can help to protect the liquid from exposure to ambient atmosphere when closed and can also help to clear or dean away any obstructions in the slotted spray nozzle 40 by ejecting or pushing any obstruction (e.g. particles, solids, agglomerates) out from the internal recess 445 and through the elongated orifice 42.

In this embodiment, the elongated orifice 42 can be opened and closed by rotating the slotted spray nozzle 40 on the external threads 53 of the discharge tube 26. The threaded engagement between the internal threads 52 on the slotted spray nozzle 40 and the external threads 53 on the discharge tube 26 allows for translational movement between the post 60 and the elongated orifice 42. Rotation of the slotted spray nozzle 40 on the threads will move the elongated orifice 42 toward the post 60 or away from the elongated orifice 42. Optionally, this translational movement can be accomplished using many other mechanical methods such as, for example, sliding engagement or the like. Most preferably, the elongated orifice 42 can be sufficiently retracted from the post 60 to allow an opening substantially equal to or greater in area than that of the discharge passage 27 between the post 60 and the internal recess 445 so that the post 60 does not obstruct the liquid flow through the slotted spray nozzle 40.

Figure 12:
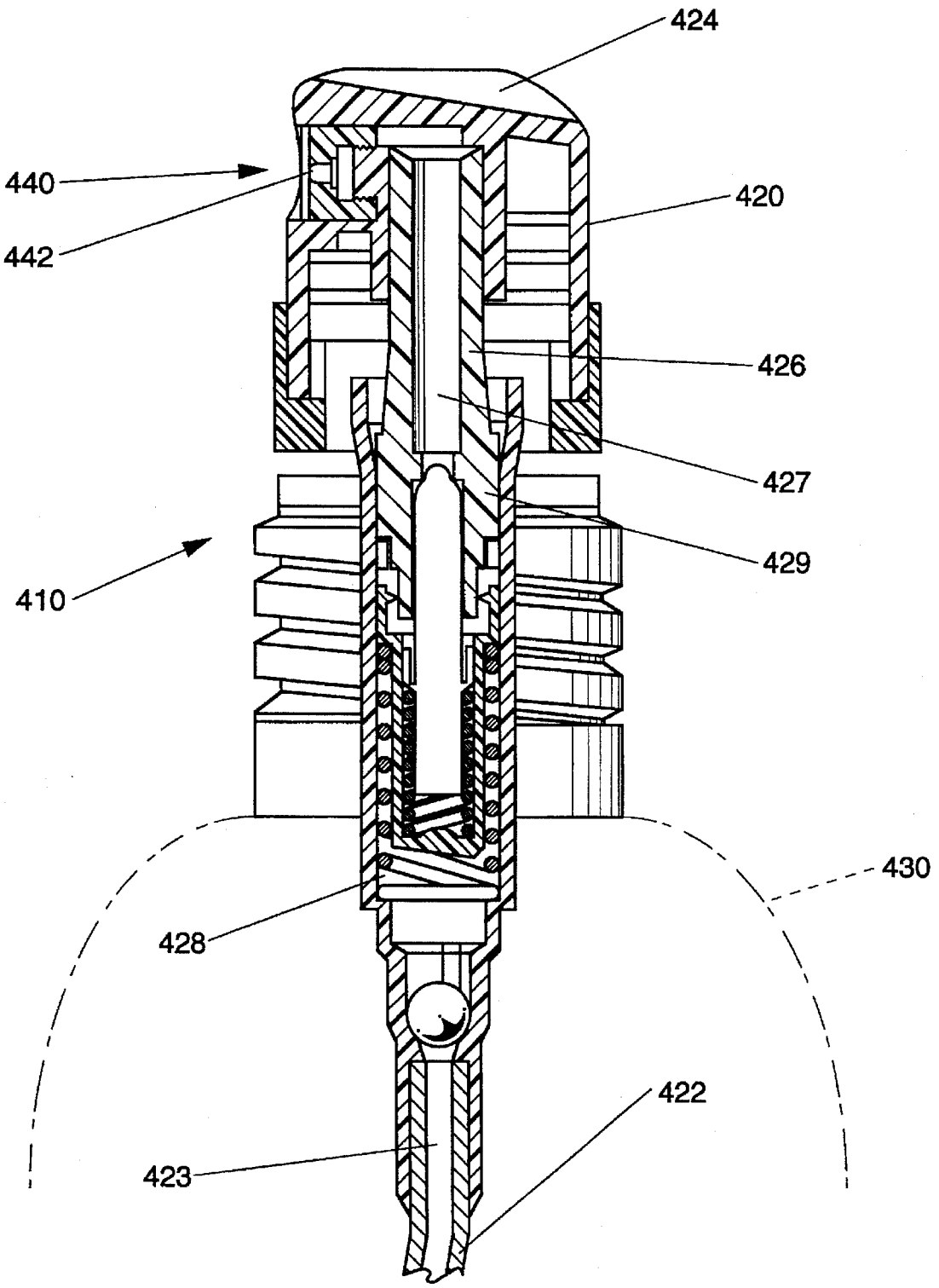
FIG. 12 is a partial cross-section similar to FIG. 2 of an alternative spray delivery system configuration according to the present invention.

While the presently preferred version of the spray delivery system 10 employs a trigger operated sprayer type pump device 20 as depicted in FIG. 1, a reciprocating finger pump type pump device 420 could also be employed in the spray delivery system 410 as depicted in FIG. 12. In such a configuration, the finger button 424 replaces the trigger 24, seen in FIG. 1, as the actuator. Other elements depicted include a slotted spray nozzle 440 having an elongated orifice 442 wherein the slotted spray nozzle is incorporated into the finger pump 420, a container 430 (shown in outline only) to house the liquid, a pump chamber 428, and a inlet tube 422 having an inlet passage 423 therein that extends downward within the container 430 from the pump chamber 428. In this reciprocating finger pump type pump device 420 the slotted spray nozzle 440 is connected to the finger button 424 so as to be in liquid communication with the discharge passage 427 of the discharge tube 426 and the finger button 424 reciprocally engages a piston 429 that is slidably fitted within the pump chamber 428 in order to effectuate actuation of the spray delivery system 410. For typical operation of such a reciprocating finger pump, see, for example, U.S. Pat. No. 4,986,453 issued Jan. 22, 1991 to Lina et al.

Although particular versions and embodiments of the present invention have been shown and described, various modifications can be made to the spray delivery system 10 and the method of assembly or operation thereof without departing from the teachings of the present invention. The terms used in describing the invention are used in their descriptive sense and not as terms of limitation, it .being intended that all equivalents thereof be included within the scope of the appended claims.

What is claimed is:

1. A hand holdable spray delivery system for dispensing a liquid, said spray delivery system comprising:

(a) a container housing said liquid, said liquid having a viscosity greater than about 60 centipoise;

(b) a manually actuated pump device mounted on said container, said pump device including an inlet passage, a pump chamber, and a discharge passage having a distal end, all being connected in liquid communication so that said liquid can be pumped from within said container, through said inlet passage, into said pump chamber and through said discharge passage upon manual actuation of said pump device;

(c) a spray nozzle including a housing having an inlet side and an exit side, said housing having an internal recess through said inlet side that terminates in an elongated orifice at said exit side, said spray nozzle is constructed of an elastomeric material allowing said elongated orifice to resiliently distort during use, said internal recess being attached in liquid communication to said distal end of said discharge passage such that said liquid passing through said discharge passage flows through said spray nozzle and converges toward said elongated orifice and is dispensed therefrom in a dispersed spray.

2. The hand holdable spray delivery system of claim 1 wherein said liquid comprises a vegetable oil based cooking spray.

3. The hand holdable spray delivery system of claim 1 further comprising a post, said post being affixed to said distal end of said discharge passage and said spray nozzle being moveable between an open position and a closed position, said open position allowing said liquid to flow through said discharge passage around said post.

4. The hand holdable spray delivery system of claim 1 wherein said exit side includes a V-shaped groove therein which intersects with said internal recess to form said elongated orifice.

5. The hand holdable spray delivery system of claim 1 wherein said elastomeric material is a thermoplastic copolyester.

6. The hand holdable spray delivery system of claim 1 wherein said elastomeric material has a hardness between about 40 Shore A to about 60 Shore D and a flexural modulus between about 1,000 psi to about 25,000 psi.

7. The hand holdable spray delivery system of claim 1 wherein said pump device further comprises a trigger operated sprayer including a trigger and a piston, said trigger serves as an actuator which reciprocally engages said piston, said piston being slidably fitted within said pump chamber in order to effectuate actuation of said spray delivery system.

8. The hand holdable spray delivery system of claim 1 wherein said pump device further comprises a reciprocating finger pump having a finger button and a piston, said spray nozzle being connected to said finger button so as to be in liquid communication with the discharge passage, said finger button reciprocally engaging said piston, said piston being slidably fitted within said pump chamber in order to effectuate actuation of said spray delivery system.

9. A hand holdable spray delivery system for dispensing a liquid, said spray delivery system comprising:

(a) a container housing said liquid;

(b) a manually actuated pump device mounted on said container, said pump device including an inlet passage, a pump chamber, and a discharge passage having a distal end, all being connected in liquid communication so that said liquid is pumped from within said container, through said inlet passage, into said pump chamber and through said discharge passage upon manual actuation of said pump device; and, (c) a spray nozzle including a housing having an inlet side and an exit side, said housing having an internal recess through said inlet side that terminates in an elongated orifice at said exit side, said internal recess having a dome shaped interior surface therein, said exit side having a groove therein which intersects with said interior surface to form said elongated orifice, said housing further including a first segment affixed to a second segment, said first segment being located at said inlet side having said internal recess extending therethrough and said second segment being located at said outlet side having said elongated orifice therein, said second segment being made of an elastomeric material, said elastomeric material allowing said elongated orifice to resiliently distort thereby substantially reducing the likelihood of clogging during use, said internal recess being attached in liquid communication to said distal end of said discharge passage such that said liquid passing through said discharge passage flows through said spray nozzle and converges toward said elongated orifice and is dispensed therefrom in a dispersed spray.

10. The hand holdable spray delivery system of claim 9 wherein said liquid has a viscosity from about 80 to about 300 centipoise.

11. The hand holdable spray delivery system of claim 9 wherein said liquid comprises a solids laden liquid containing up to about 10% solid particulate material.

12. The hand holdable spray delivery system of claim 10 wherein said elastomeric material is a thermoplastic copolyester.

13. The hand holdable spray delivery system of claim 10 wherein said elastomeric material has a hardness between about 40 Shore A to about 60 Shore D and a flexural modulus between about 1,000 psi to about 25,000 psi.

14. The hand holdable spray delivery system of claim 10 wherein said pump device further comprises a trigger operated sprayer including a trigger and a piston, said trigger serves as an actuator which reciprocally engages said piston, said piston being slidably fitted within said pump chamber in order to effectuate actuation of said spray delivery system.

15. The hand holdable spray delivery system of claim 10 wherein said pump device further comprises a reciprocating finger pump having a finger button and a piston, said spray nozzle being connected to said finger button so as to be in liquid communication with the discharge passage, said finger button reciprocally engaging said piston, said piston being slidably fitted within said pump chamber in order to effectuate actuation of said spray delivery system.

16. The hand holdable spray delivery system of claim 10 wherein said liquid comprises a vegetable oil based cooking spray including salt particles.

17. The hand holdable spray delivery system of claim 10 wherein said first segment is affixed to said second segment by co-injection molding.

* * * * *

UNITED STATES PATENT AND TRADEMARK OFFICE
CERTIFICATE OF CORRECTION

PATENT NO. : 5,642,860

DATED : July 1, 1997

INVENTOR(S) : Bush et al.

It is certified that error appears in the above-identified patent and that said Letters Patent is hereby corrected as shown below:

Claim 12, line 1 "claim 10" should read --claim 9--.

Claim 13, line 1 "claim 10" should read --claim 9--.

Claim 14, line 1 "claim 10" should read --claim 9--.

Claim 15, line 1 "claim 10" should read --claim 9--.

Claim 16, line 1 "claim 10" should read --claim 9--.

Claim 17, line 1 "claim 10" should read --claim 9--.

Signed and Sealed this

Fifth Day of May, 1998

*Attest:*

Bruce Lehman

BRUCE LEHMAN

*Attesting Officer*

*Commissioner of Patents and Trademarks*